US006985856B2

(12) United States Patent
Wang et al.

(10) Patent No.: US 6,985,856 B2
(45) Date of Patent: Jan. 10, 2006

(54) METHOD AND DEVICE FOR COMPRESSED-DOMAIN PACKET LOSS CONCEALMENT

(75) Inventors: Ye Wang, Kent Vale (SG); Juha Ojanperä, Tampere (FI); Jari Korhonen, Tampere (FI)

(73) Assignee: Nokia Corporation, Espoo (FI)

( * ) Notice: Subject to any disclaimer, the term of this patent is extended or adjusted under 35 U.S.C. 154(b) by 322 days.

(21) Appl. No.: 10/335,543

(22) Filed: Dec. 31, 2002

(65) Prior Publication Data

US 2004/0128128 A1 Jul. 1, 2004

(51) Int. Cl.
*G10L 19/00* (2006.01)

(52) U.S. Cl. ..... 704/226

(58) Field of Classification Search ..... 704/200, 704/200.1, 211–230; 714/751, 807; 370/216; 386/68

See application file for complete search history.

(56) References Cited

U.S. PATENT DOCUMENTS 5,862,518 A * 1/1999 Nomura et al. ..... 704/214
5,928,379 A * 7/1999 Hattori ..... 714/807
6,327,689 B1 * 12/2001 Tian ..... 714/751
6,490,243 B1 * 12/2002 Tanaka et al. ..... 370/216
2002/0126988 A1 * 9/2002 Togashi et al. ..... 386/68

OTHER PUBLICATIONS

Brandenburg et al., ISO-MPEG-1 Audio: A Generic Standard for Coding of High-Quality Digital Audio, 92nd Convention of the Audio Engineering Society, Vienna, Austria, Mar. 24-27, 1992, revised Jul. 15, 1994, pp. 780-792.*

"Error Robustness Scheme for Perceptually Coded Audio Based on Interframe Shuffling of Samples"; J. Korhonen; Proc. of IEEE International Conference on Acoustics, Speech and Signal Processing 2002, Orlando, Florida; pp. 2053-2056; May 2002.

* cited by examiner

*Primary Examiner*—David D. Knepper
(74) *Attorney, Agent, or Firm*—Ware, Fressola, Van Der Sluys & Adolphson LLP

(57) ABSTRACT

An error concealment method and device for recovering lost data in the AAC bitstream in the compressed domain. The bitstream are partitioned into frames each having a plurality of data parts including the header/global gain, scale factors and QMDCT coefficients. The data parts are stored in a plurality of buffers, so that if one or more data parts of a current frame is corrupted or lost, the corresponding data part in the neighboring frames is used to conceal the errors in the current frame.

13 Claims, 12 Drawing Sheets

METHOD AND DEVICE FOR COMPRESSED-DOMAIN PACKET LOSS CONCEALMENT

CROSS REFERENCES TO RELATED APPLICATIONS

The present invention is related to a copending U.S. patent application Ser. No. 10/281,395, filed Oct. 23, 2002, assigned to the assignee of the present invention. The present invention is also related to, and may have been claimed in part in a copending patent application No. PCT/IB02/02193, application date Jun. 14, 2002, assigned to the assignee of the present invention.

FIELD OF THE INVENTION

The present invention relates generally to error concealment and, more particularly, to packet loss recovery for the concealment of transmission errors occurring in digital audio streaming applications.

BACKGROUND OF THE INVENTION

If a streaming medium is available in a mobile device, a user can use the mobile device for listening to music, for example. For music listening applications, audio signals are generally compressed into digital packet formats for transmission. The transmission of compressed digital audio, such as MP3 (MPEG-1/2 layer 3), over the Internet has already had a profound effect on the traditional process of music distribution. Recent developments in the audio signal compression field have rendered streaming digital audio using mobile terminals possible. With the increase in network traffic, a loss of audio packets due to traffic congestion or excessive delay in the packet network is likely to occur. Moreover, the wireless channel is another source of errors that can also lead to packet losses. Under such conditions, it is crucial to improve the quality of service (QoS) in order to induce widespread acceptance of music streaming applications.

To mitigate the degradation of sound quality due to packet loss, various prior art techniques and their combinations have been proposed. UEP (unequal error protection), a subclass of forward error correction (FEC), is one of the important concepts in this regard. UEP has been proven to be a very effective tool for protecting compressed domain audio bitstreams, such as MPEG AAC (Advanced Audio Coding), where bits are divided into different classes according to their bit error sensitivities. Using UEP for error concealment of percussive sound has been disclosed in U.S. patent application Ser. No. 10/281,395.

In another approach, Korhonen ("Error Robustness Scheme for Perceptually Coded Audio Based on Interframe Shuffling of Samples", Proc. of IEEE International Conference on Acoustics, Speech and Signal Processing 2002, Orlando Fla., pp. 2053–2056, May 2002) separates an audio frame to two parts: a critical data part and a less critical data part. The payload including the critical data part is transported via a reliable means, such as TCP (Transmission Control Protocol), while the less critical data part is transported by such means as UDP (User Datagram Protocol).

However, due to the error characteristics of mobile IP networks and the constraints on latency, packet delivery in the various UEP schemes and the selective retransmission schemes is still not very reliable. Especially when errors are due to packet losses in the congested IP networks, bit errors in wireless air interfaces, and hand-over in cellular networks. Thus, it is advantageous and desirable to provide a robust method and system for high quality audio streaming over packet networks, such as mobile IP networks, 2.5 G and 3 G networks and bluetooth. Such method and system must take into account the required computational complexity and memory/power consumption.

MPEG-2/MPEG-4 AAC coders and their related data structure are known in the art. The data structure of an AAC frame is shown in FIG. 1. The frame comprises a critical data part (e.g. header), the scale factors and Quantized Modified Discrete Cosine Transform coefficients (QMDCT data). An MPEG-2 decoder is shown in FIG. 2. As shown, the decoder 10 comprises a bitstream demultiplexer for receiving a 13818-7 coded audio stream 200 and providing signals (thinner lines) and data (thick line) to various decoding tools in the decoder. The tools in the decoder 10 comprise a gain control module, an AAC spectral processing block and an AAC decoding block. As shown in FIG. 2, the critical data part 110 in an AAC frame can be obtained from the signals 220 and data 230 provided by the bitstream demultiplexer. The QMDCT data 112 can be obtained from the output of the noiseless decoding tool. The scale factors 114 can be obtained from the output of the scale factors decoding tool. In prior art, error concealment is mostly carried out in the time domain (PCM sample 240, for example) or spectral domain (MDCT and IMDCT coefficients, for example). The prior art solutions require more on memory, computation and power consumption. When audio streaming is carried out in a mobile terminal, it is desirable to use an error concealment method where memory requirement, computation complexity and power consumption can be substantially reduced.

SUMMARY OF THE INVENTION

The present invention provides a method and device for error concealment of transmission errors occurring in digital audio streaming. More specifically, packet loss due to transmission are recovered in the compressed domain. Error concealment is carried out in three separate data parts of the AAC frames: the critical data part including the header and the global gain, the QMDCT data and the scale factors. These data parts are stored in a plurality of buffers so that if one or more of the data parts are lost or corrupted, the corresponding data parts in the neighboring frames are used to conceal the errors in the current frame.

Thus, according to the first aspect of the present invention, there is provided a method of error concealment in a bitstream indicative of audio signals, wherein the bitstream comprises a current frame and at least one neighboring frame, each frame having a plurality of data parts in a compressed domain. The method is characterized by storing said plurality of data parts in the compressed domain in said at least one neighboring frame, determining whether the current frame is defective, detecting at least one defective data part in the current frame if the current frame is defective, and recovering said at least one defective data part in the current frame based on at least one of the stored data parts in said at least one neighboring frame.

If the defective data part in the current frame is a header, the defective header is recovered based on a statistical characteristic associated with the header of said at least one of the stored data parts in said at least one neighboring frame.

If the defective data part in the current frame is the global gain value, the defective data part is recovered based on the global gain in said at least one neighboring frame for recovering said at least one defective data part in the current frame.

Preferably, said at least one neighboring frame includes a first frame having a first global gain value and a second frame having a second global gain value smaller than the first global gain value, the defective data part in the current frame is recovered based on the second global gain value.

If the defective data parts in the current frame include one or more scale factors, the defective data parts are recovered based on the scale factors in said at least one neighboring frame for recovering said at least one defective data part in the current frame.

If the defective data parts in the current frame include the QMDCT coefficients, the defective data parts are recovered based on the QMDCT coefficients in said at least one neighboring frame, especially those in the lower frequency region. It is possible that the lost QMDCT coefficients in the current frame can be replaced by zeros.

According to the second aspect of the present invention, there is provided an audio decoder for decoding a bitstream indicative of audio signals for providing audio data in a modulation domain, wherein the bitstream comprises a current frame and at least one neighboring frame, each frame having a plurality of data parts, said decoder comprising a first module for decoding said each frame for providing a signal indicative of the plurality of data parts in a compressed domain. The decoder is characterized by a second module, responsive to the signal, for storing said plurality of data parts in the compressed domain in said at least one neighboring frame, and by a third module for detecting at least one defective data part in the compressed domain if the current frame is defective, so as to recover said at least one defective data part in the current frame based on at least one of the stored data parts in said at least one neighboring frame.

According to the third aspect of the present invention, there is provided an audio receiver adapted to receive packet data in audio streaming, said receiver comprising an unpacking module for unpacking the received packet data into a bitstream indicative of audio signals, wherein the bitstream comprises a current frame and at least one neighboring frame, each frame having a plurality of data parts. The receiver is characterized by a decoding module, for decoding said each frame for providing a signal indicative of the plurality of data parts in a compressed domain, by a storage module, responsive to the signal, for storing said plurality of data parts in the compressed domain in said at least one neighboring frame, and by an error concealing module for detecting at least one data part in the current frame if the current frame is defective so as to recover said at least one defective data part in the current frame based on at least one of the stored data parts in said at least one neighboring frame.

According to the fourth aspect of the present invention, there is provided a telecommunication device, such as a mobile terminal. The telecommunication device comprises:

an antenna, and an audio receiver connected to the antenna for receiving packet data in audio streaming, wherein the receiver comprises an unpacking module for unpacking the received packet data into a bitstream indicative of audio signals, wherein the bitstream comprises a current frame and at least one neighboring frame, each frame having a plurality of data parts, and wherein the receiver further comprises:

a decoding module, for decoding said each frame for providing a signal indicative of the plurality of data parts in a compressed domain, a storage module, responsive to the signal, for storing said plurality of data parts in the compressed domain in said at least one neighboring frame, and an error concealing module for detecting at least one data part in the current frame if the current frame is defective so as to recover said at least one defective data part in the current frame based on at least one of the stored data parts in said at least one neighboring frame.

The present invention will become apparent upon reading the description taken in conjunction with FIGS. 3 to 13.

BEST MODE TO CARRY OUT THE INVENTION

After applying various UEP (unequal error protection) schemes, the situation in the receiver side is likely to be that the most packet loss occurs in the QMDCT (Quantized Modified Discrete Cosine Transform) data in an AAC frame. Some packet loss occurs in the AAC scale factors. In rare situations, packet loss can occur in the critical data, or the AAC header and global_gain. If the critical data is loss, it is very difficult to decode the rest of that AAC frame.

Figure 2:
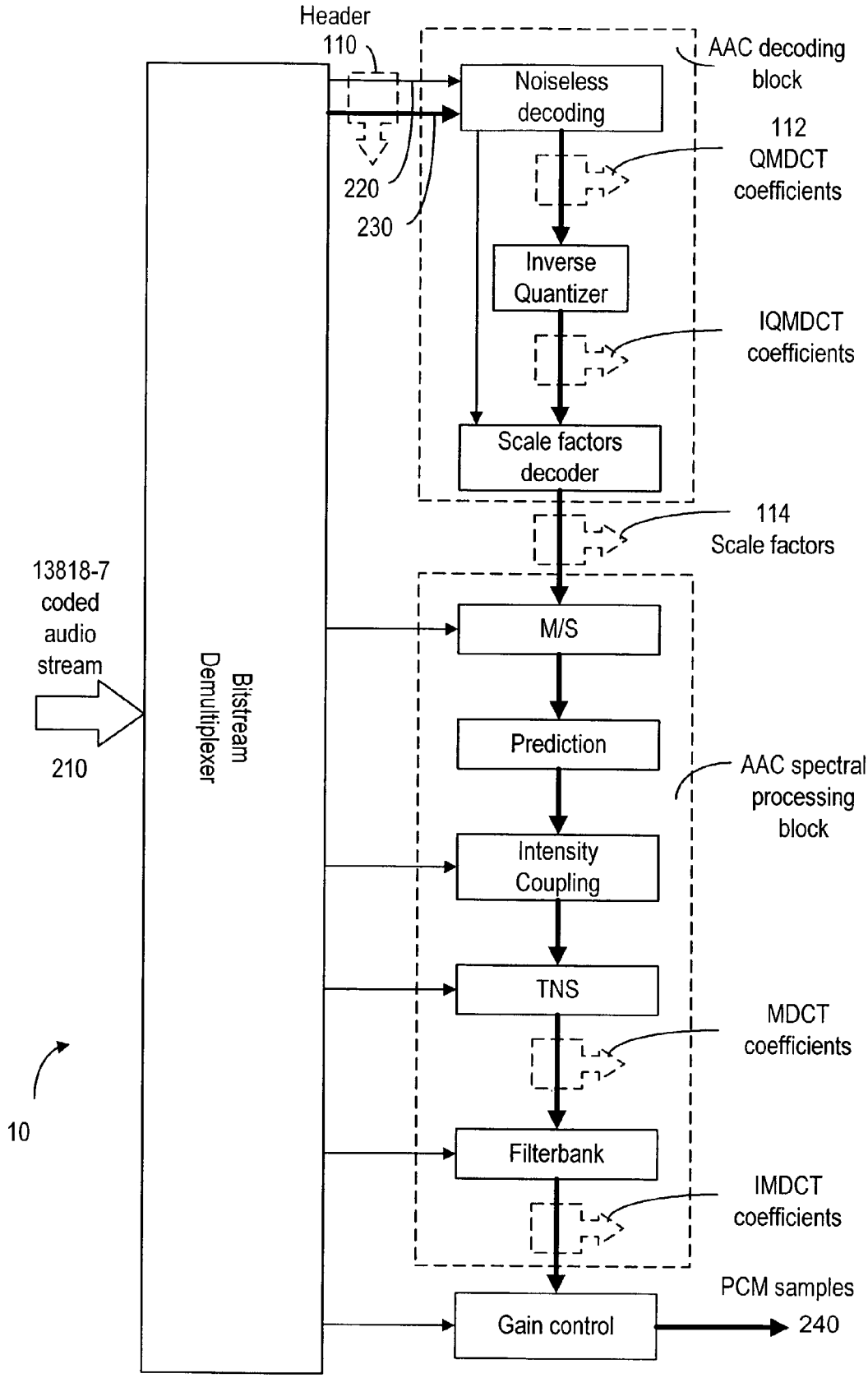
FIG. 2 is a block diagram illustrating a prior art MPEG-2 AAC decoder.
Figure 3:
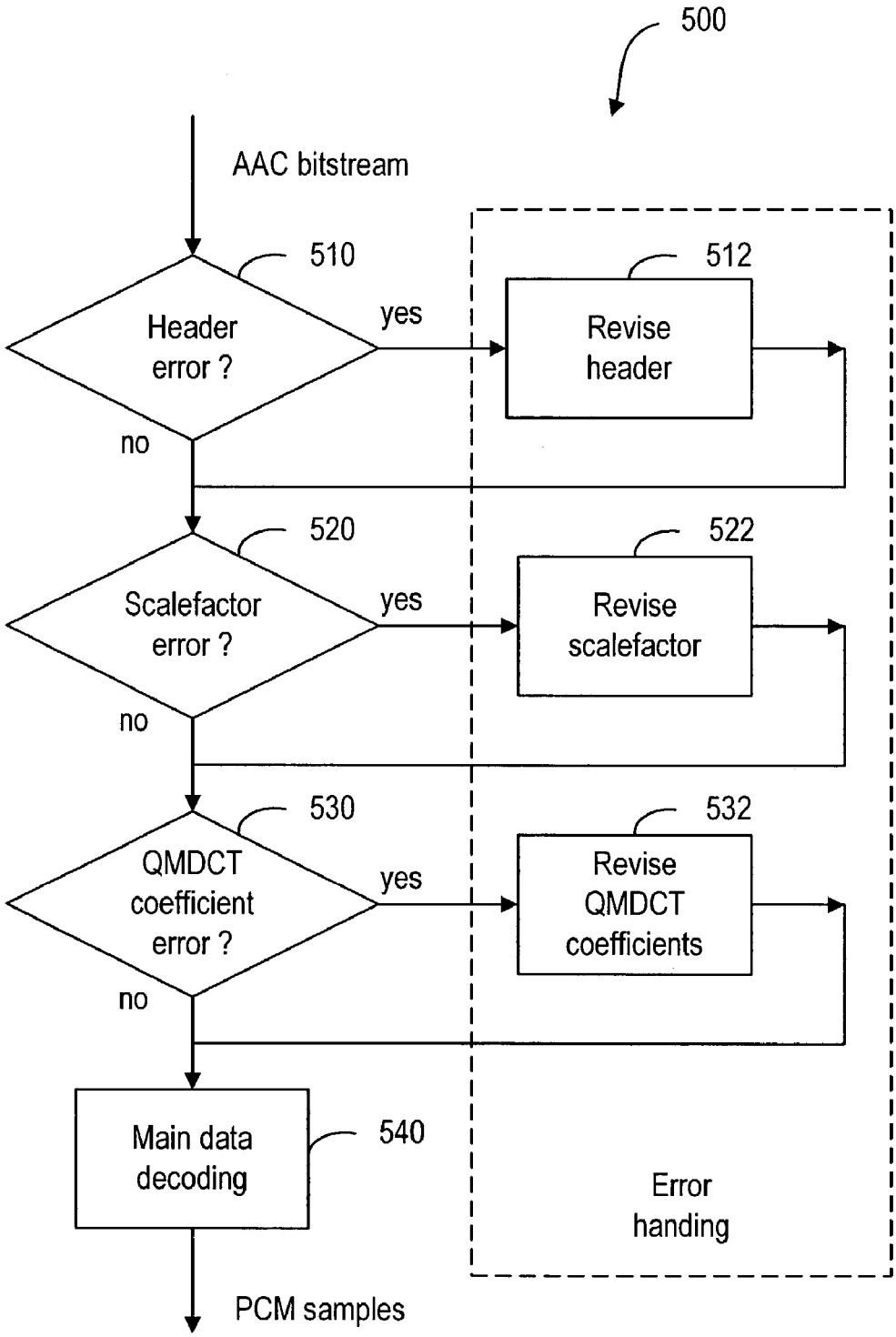
FIG. 3 is a flowchart illustrating the method of error concealment, according to the present invention.

Thus, the present invention carries out error concealment directly in the compressed domain. More particularly, the present invention conceals errors in three separate parts of the AAC frame: the critical data part including the header and the global_gain, the QMDCT data and the scale factors. The error concealment method, according to the present invention, is illustrated in the flowchart 500 of FIG. 3. After the coded audio bitstream is sorted by the bitstream demultiplexer (FIG. 2), data 110 indicative of the header and global gain in an AAC frame, data 112 indicative of the QMDCT coefficients, and data 114 indicative of the scale factors are obtained and examined for error concealment purposes. At step 510, data 110 is checked to determine whether an error occurs in the header and global_gain. If an error occurs, the AAC bitstream is routed to an error handler, where the header/global_gain error is corrected at step 512. If there is no error in the header/global_gain data, data 112 is checked to determine, at step 520, whether an error occurs in the QMDCT coefficients. If an error occurs, the AAC bitstream is routed to the error handler where the error in QMDCT coefficients is corrected at step 522. It is followed that the data 114 is checked to determine, at step 530, whether an error occurs in the scale factors. If so, the error in the scale factors is corrected at step 532. After these error concealment steps, the error-concealed AAC bitstream is decoded by a data decoder at step 540 to become PCM samples.

Figure 12:
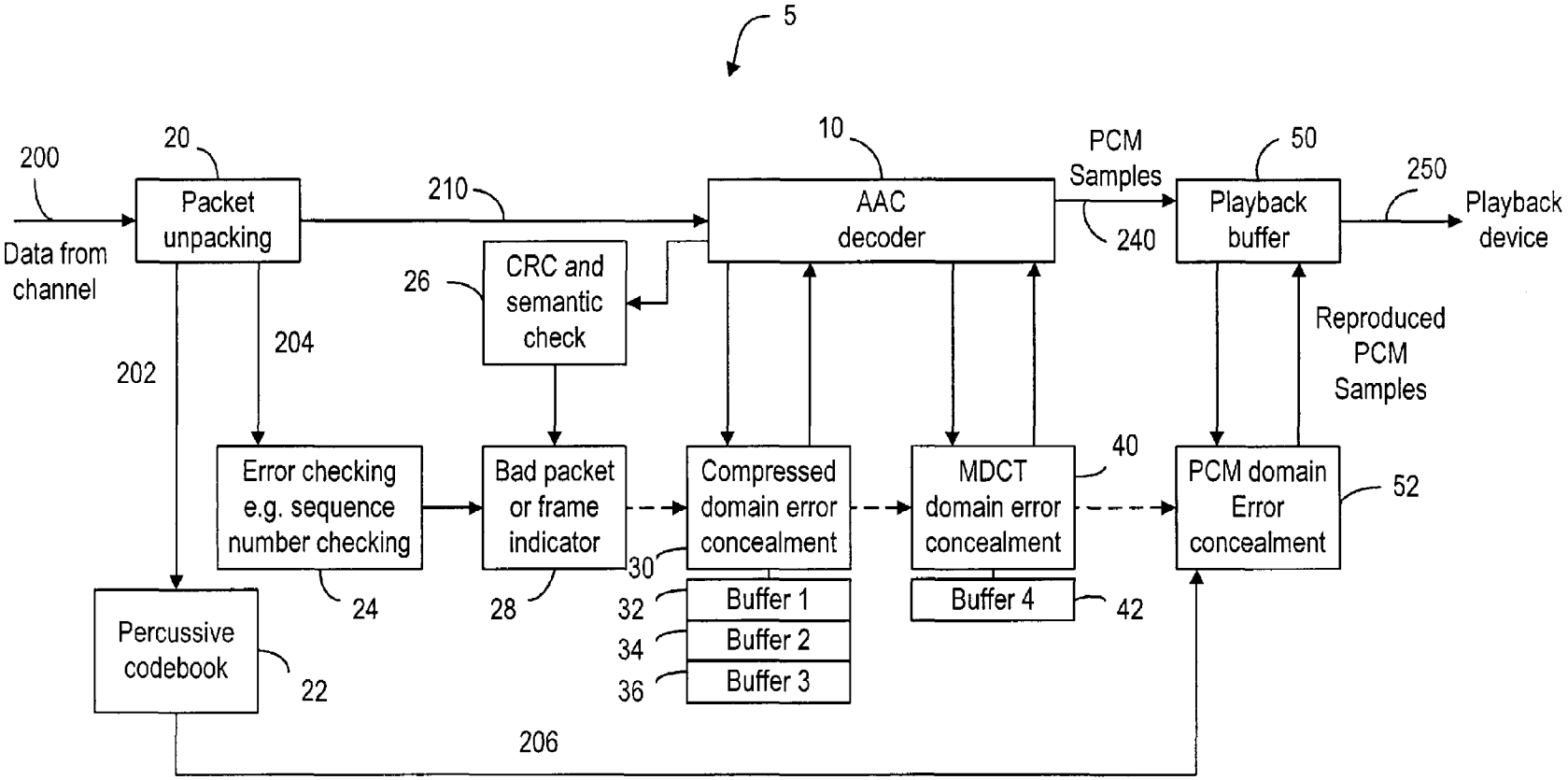
FIG. 12 is a block diagram illustrating a receiver capable of carrying out the error concealment method, according to the present invention.

For concealing errors in data 110, 112 and 114 in a current AAC frame, it is preferred that corresponding data in at least one previous frame is stored in a buffer. A receiver capable of carrying out the present invention is shown in FIG. 12.

Because the data indicative of the AAC header and global_gain is the most critical data in error concealment, the protection of this critical data must be emphasized. The protection can be achieved by a number of ways as described below.

1) The critical data can be transmitted in advance, before the streaming starts. In this way, the occurrence of packet loss is most likely in the QMDCT data and the scale factors.

2) The critical data is protected by a selective re-transmission scheme. Because the critical data occupies less than 10% of the bits in most AAC bitstreams, a network-based re-transmission scheme will not reduce the transmission bandwidth significantly.

3) The critical data is embedded in multiple packets as ancillary data in the sender side.

Figure 1:
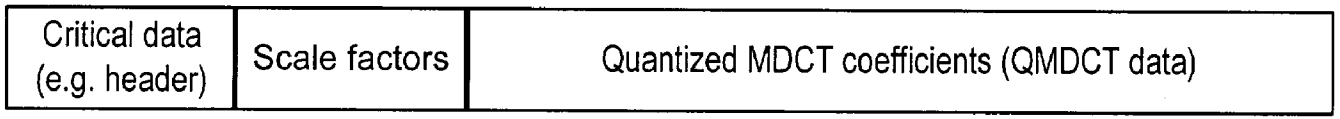
FIG. 1 is a block diagram illustrating the data structure of an AAC frame.
Figure 4:
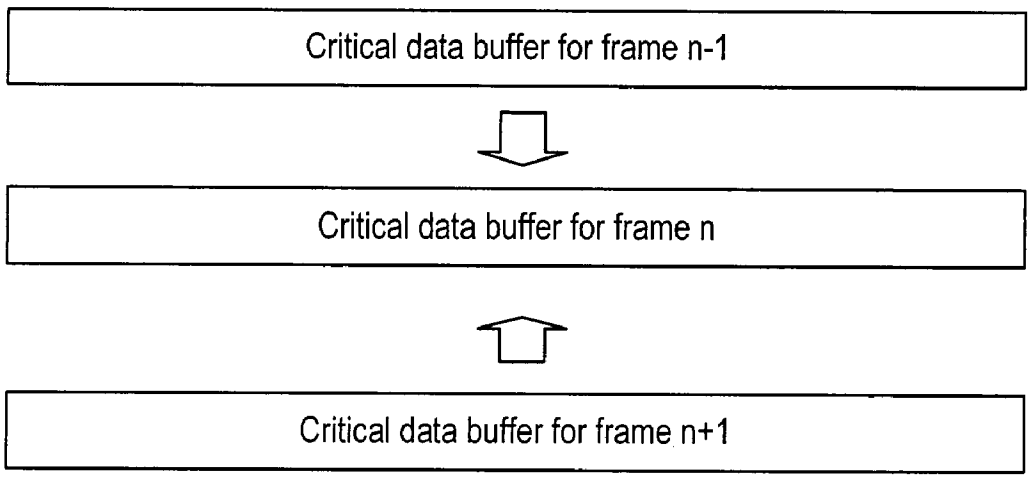
FIG. 4 is a schematic representation showing the recovery of a corrupted critical data part of an AAC frame.

With any one of these methods, the critical data of one or more frames can be stored in the receiver side. In case the packet loss is in the critical data, at least part of the critical data can be derived from neighboring frames based on their statistical characteristics and data structures. For example, the MDCT window_sequence of a frame n can be determined from the corresponding data in frames n−1 and n+1. Likewise, the window_shape can be reliably estimated from the neighboring frames. Regarding the global_gain, it is preferred that the smaller one of the global_gain values in the neighbor frames n−1 and n+1 be used to replace the missing value in the frame n. The criterion reflects the fact that a fill-in sound segment that results in a dip is perceptually more pleasant than that of a surge, according to psychoacoustics. The critical data buffer for error concealment in the critical data is shown in FIG. 4.

After the critical data in the corrupted frame n is derived based on the critical data in frame n−1 and frame n+1 and the derived critical data is stored, there are at least two ways to generate the fill-in:

1. Estimate the missing scale factors and QMDCT data for frame n from neighboring frames as described later herein.

2. Mute the entire frame n in the compressed domain by setting the scale factors and the QMDCT coefficients in the frame to zero, and conceal the errors in the MDCT domain or PCM domain (see FIGS. 2 and 12).

If the packet loss is in the AAC scale factors only (i.e., the AAC header and the global_gain in the same frame are available), then the global_gain and the Huffman table can be used to code the individual scale factors. Furthermore, the sections with zero scale factors can be obtained from the section_data and the maximum value in each data section. As such, it is possible to estimate the individual DPCM (differential pulse code modulation) scale-factor and even the entire scale-factors in the AAC frame. The basic methodology for estimating the missing data is a partial pattern matching approach.

Figure 5:
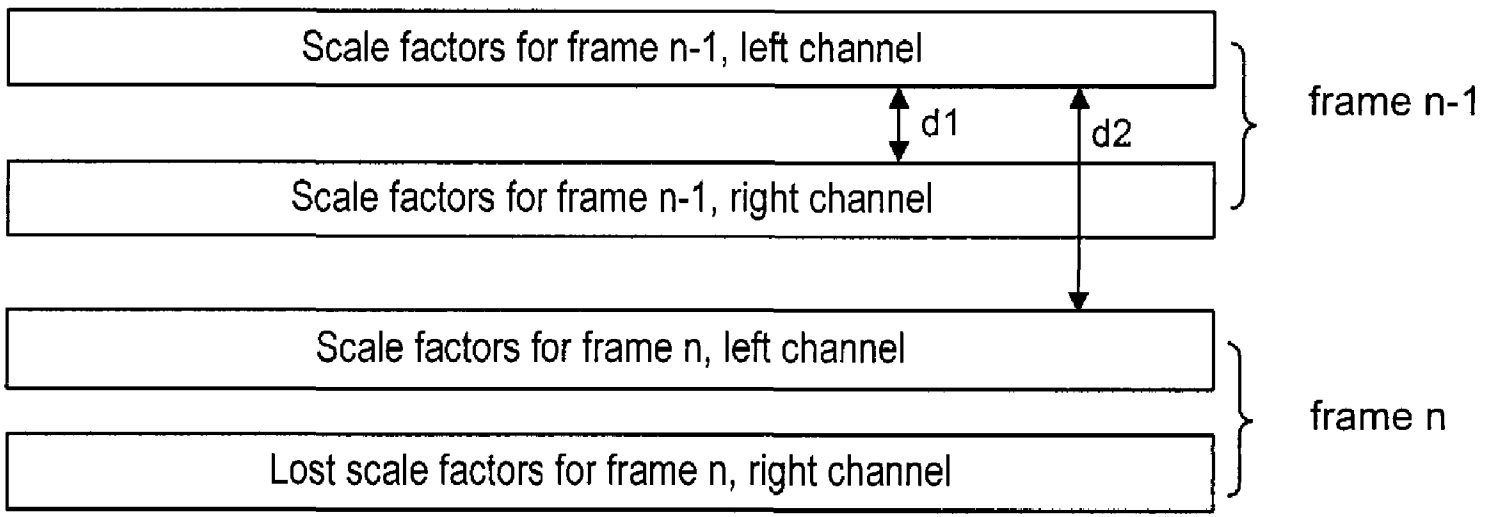
FIG. 5 is a schematic representation showing the recovery of lost scale factors.
Figure 6:
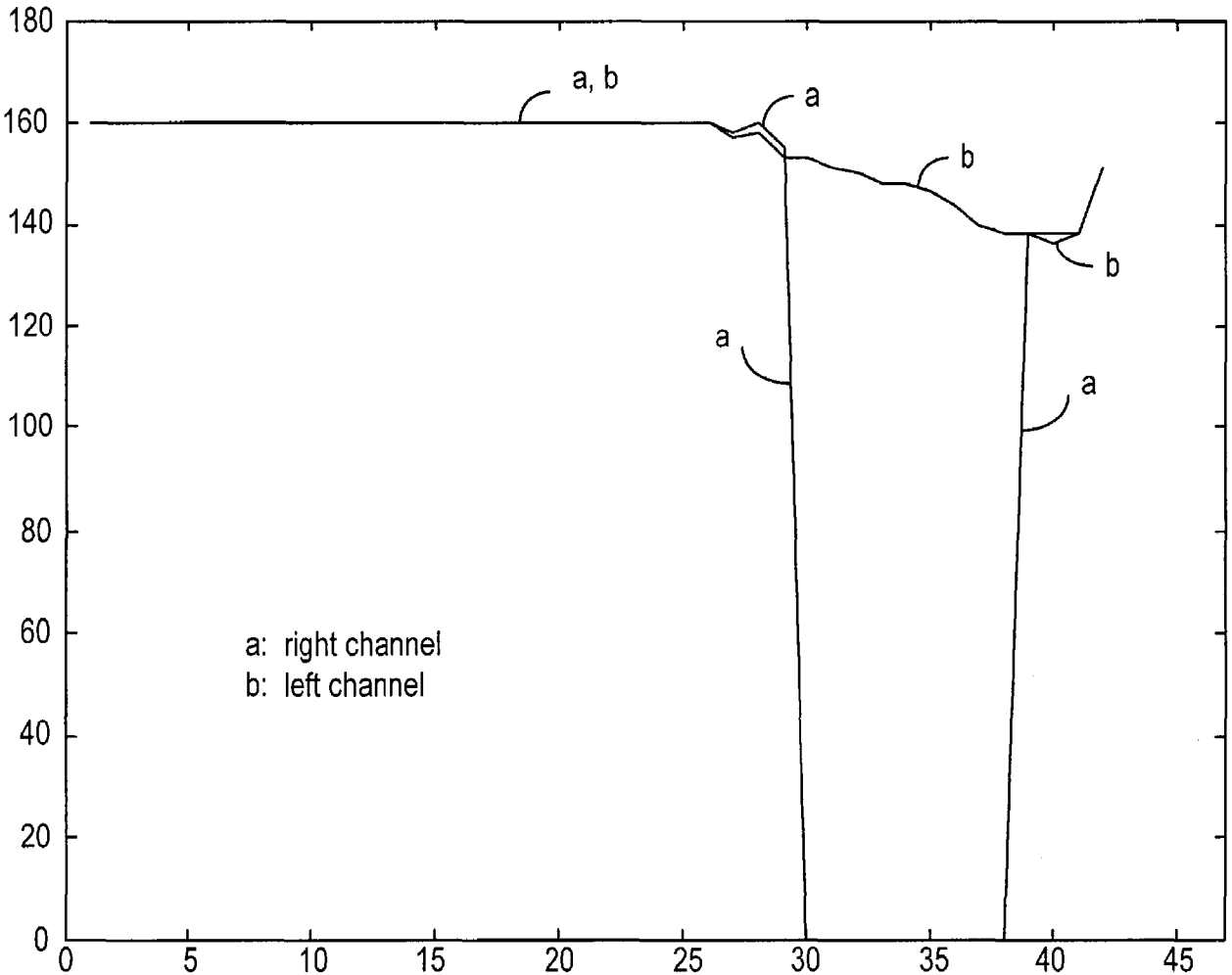
FIG. 6 is a plot showing long-windowed scale factors of left and right channels of an AAC frame.
Figure 7:
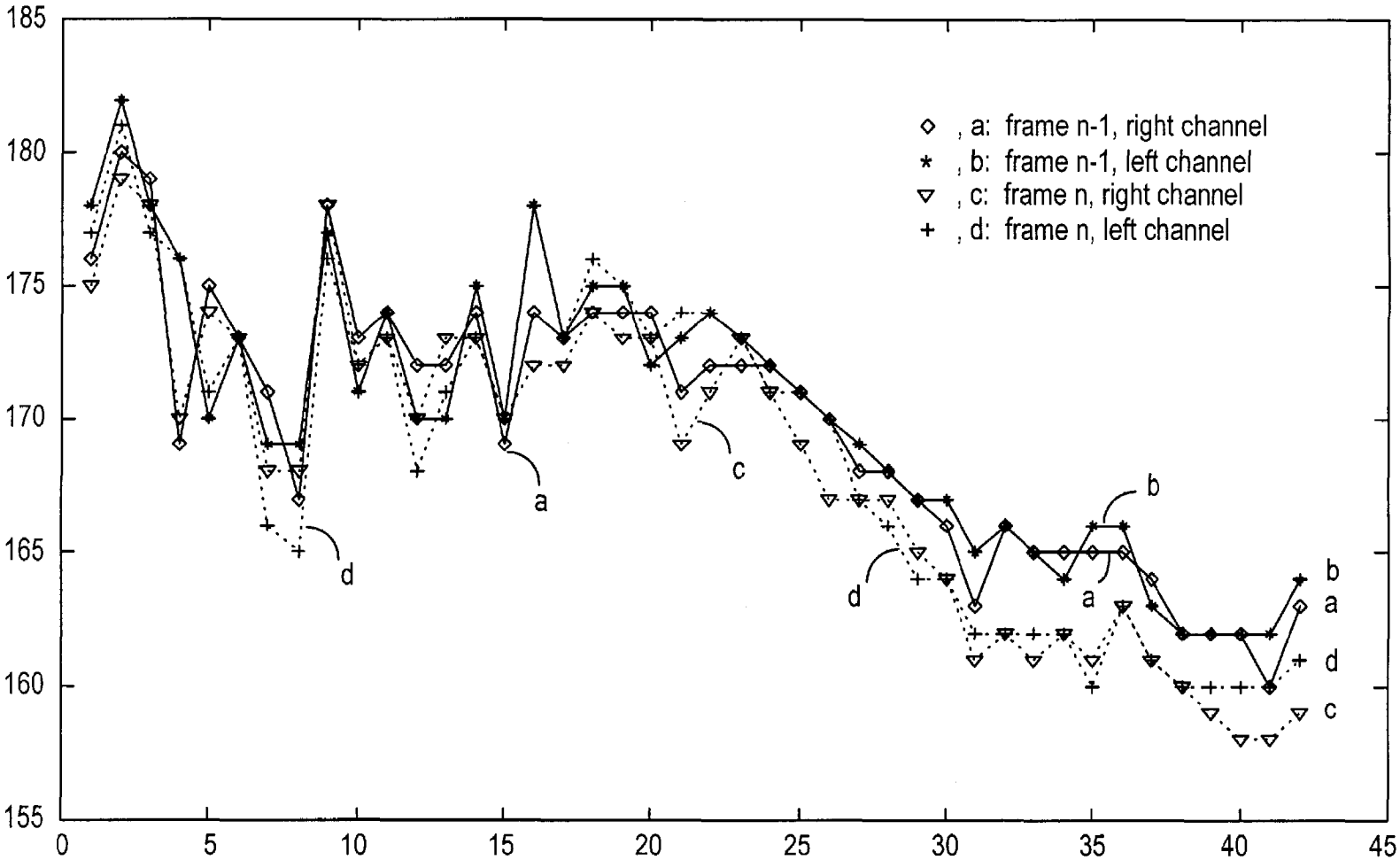
FIG. 7 is a plot showing another example of long-windowed scale factors.
Figure 8:
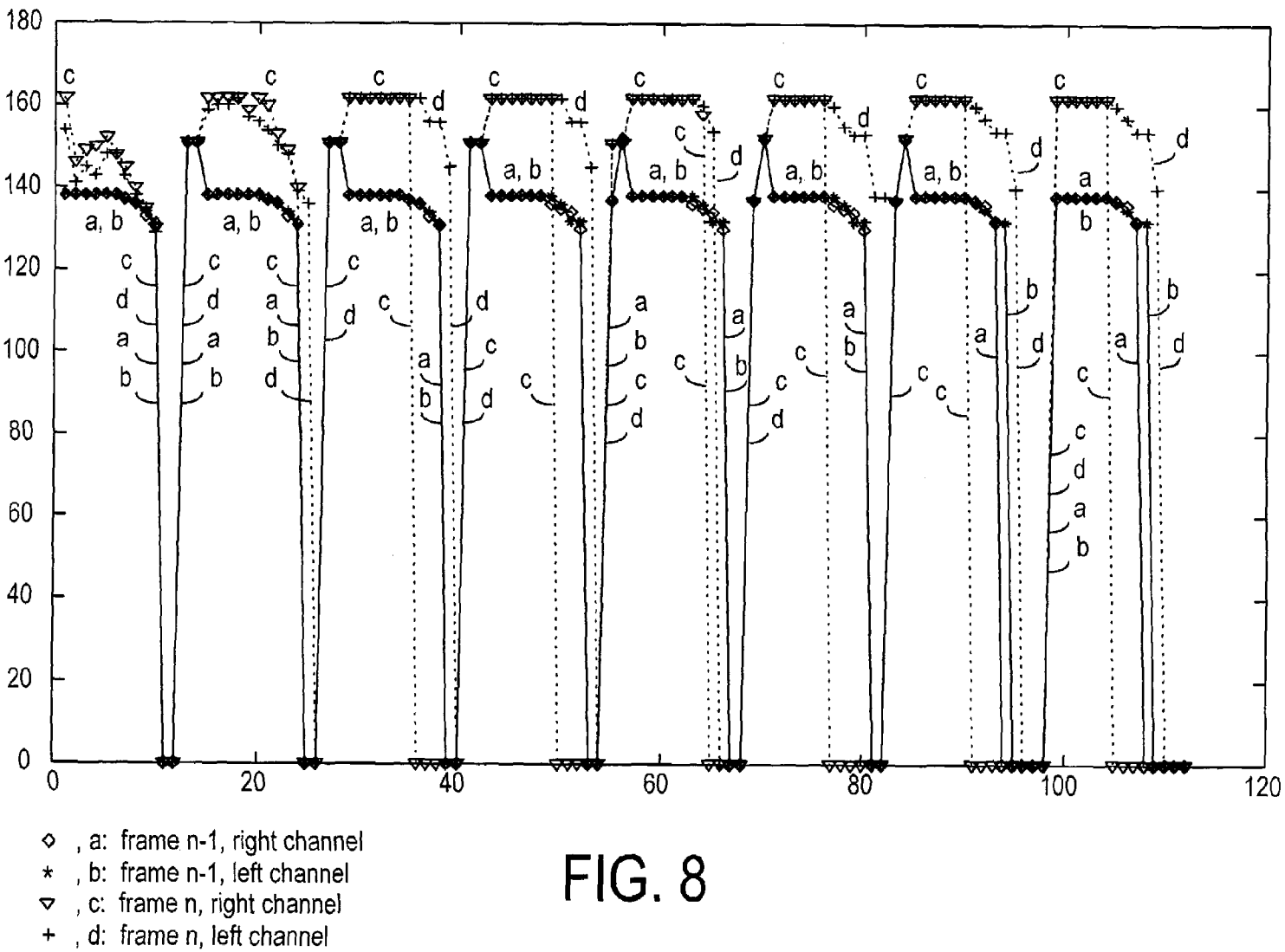
FIG. 8 is a plot showing short-windowed scale factors of two adjacent AAC frames

The errors in the scale factors can occur in different ways: 1). The entire scale factors in an AAC frame are lost; 2) a section of the scale factors in the AAC frame is lost; and 3) an individual scale factor in the AAC frame is lost. When all scale factors in an AAC frame are lost, the missing scale factors can be calculated based on one or more neighboring frames, as shown in FIG. 5. FIG. 5 shows the situation when stereo music is coded, and thus a frame has two channels. By considering the scale vectors in each channel as a vector, the contours of neighboring vectors can be used to decide whether the inter-frame or the inter-channel correlation is dominant. If inter-channel correlation is higher than inter-frame correlation, the missing scale factor vector is replaced by the adjacent channel scale factor vector, and vice versa. It should be noted that because the dimension of the scale_factors vectors of long windows is different from that of short windows, it is necessary to store the scale_factors vectors for both long and short windows for error concealment purposes. FIGS. 6 and 7 show examples of long-windowed scale factors, and FIG. 8 shows an example of short-windowed scale factors of two AAC frames of an audio bitstream. In FIGS. 6, 7 and 8, the first scale_factor is used to present the global_gain. If the scale factors of the short windows are lost, they should be recovered using the stored short-windowed scale factors. Likewise, if the scale factors of the long windows are lost, they should be recovered using the stored long-windowed scale factors.

Excluding the first scale factor, which is the global_gain, we calculate the partial Euclidian distance $d_{x,y}$ between two channels x, y as follows:

$$d = \sum_{i=1}^{N} \sqrt{(SCF_{x,i} - SCF_{y,i} - c)^2 \cdot w_i} ,$$

where N is the number of scale factors in a channel, SCF is an individual scale factor, w is a perceeptual weighting factor and $c=G_{x,}-G_y$ and $G_{x,}$, $G_y$ are global_gains of channels x an y. For more sophisticated implementation, c can be derived with a search method to yield the minimum distance between the two channels.

For example, if a section or all of the scale factors for the right channel of frame n are lost, the partial Euclidian distance $d_1$ between the left and right channels of frame n−1 and the partial Euclidian distance $d_2$ between the left channel of frame n−1 and the left channel of frame n are computed in order to decide whether inter-channel correlation or inter-frame correlation is used for error concealment purposes. If $d_1>d_2$ (or lag=2), then inter-frame correlation should be used and the lost scale factors in the right channel of frame n should be recovered based on the scale factors in the right channel of frame n−1. If $d_1<d_2$ (or lag=1), then inter-channel correlation should be used and the lost scale factors in the right channel of frame n should be recovered based on the scale factors in the left channel of frame n. Before replacing the missing scale factors with the stored ones, some adjustments may be necessary in order to prevent any false energy surge or to avoid creating false salient frequency components. For example, the global_gain offset, c, between two channels should be taken into account.

Figure 9:
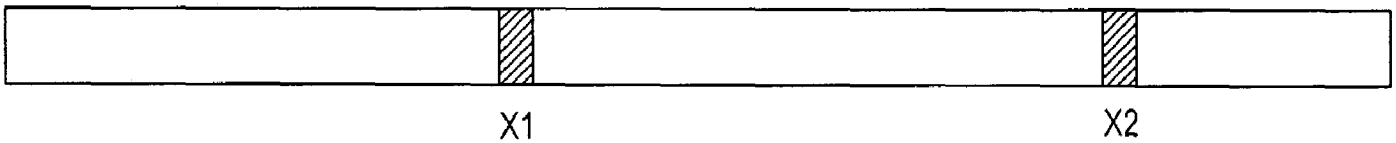
FIG. 9 is schematic representation showing a scale factor vector in an AAC frame.
Figure 10:
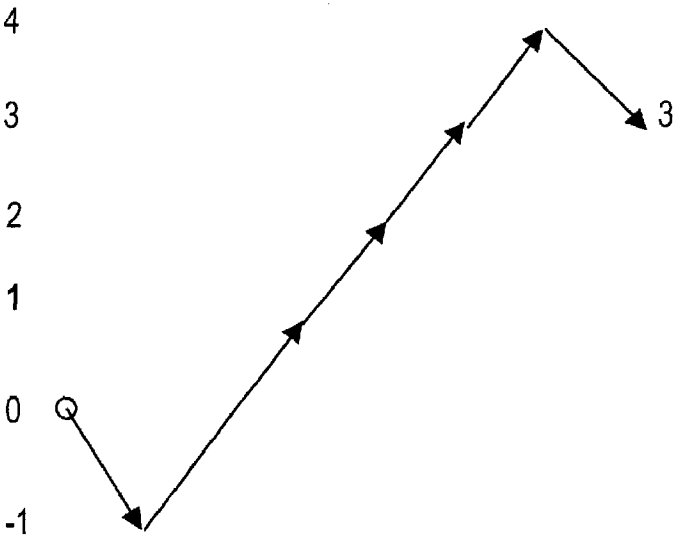
FIG. 10 is a schematic representation showing the search process to estimate a missing coded scale factor.

If an individual scale factor in an AAC frame is lost and its position is known, it is possible to estimate the missing DPCM coded scale factor if the scale factors in one or more neighboring frames are not corrupted. Without losing generality, we assume that two individual scale factors are missing, as shown in FIG. 9. In FIG. 9, the missing scale factors $x_1$, $x_2$ are shown as the shaded areas, each located between vectors (blank areas) of uncorrupted scale factors in the same frame. We can decode the scale factors in the frame until the first missing scale factor $x_1$ occurs. Although the data between $x_1$ and $x_2$ are correct, they cannot be used directly because of the nature of DPCM coding. However, a search method can be used to estimate the missing scale factor $x_1$, as shown in FIG. 10. The search starts from zero, because it is the most likely value of the missing scale factor $x_1$, and stops at the scale factor before $x_2$. At each step, a partial Euclidian distance is calculated and, among the calculated values, the minimum Euclidian distance is used to estimate the missing scale factor $x_1$. In the search, as shown in FIG. 10, the minimum Euclidian distance is found at the $6^{th}$ step and the missing scale factor $x_1$ is 3. The missing scale factor $x_2$ can be determined in a similar manner.

Figure 11A:
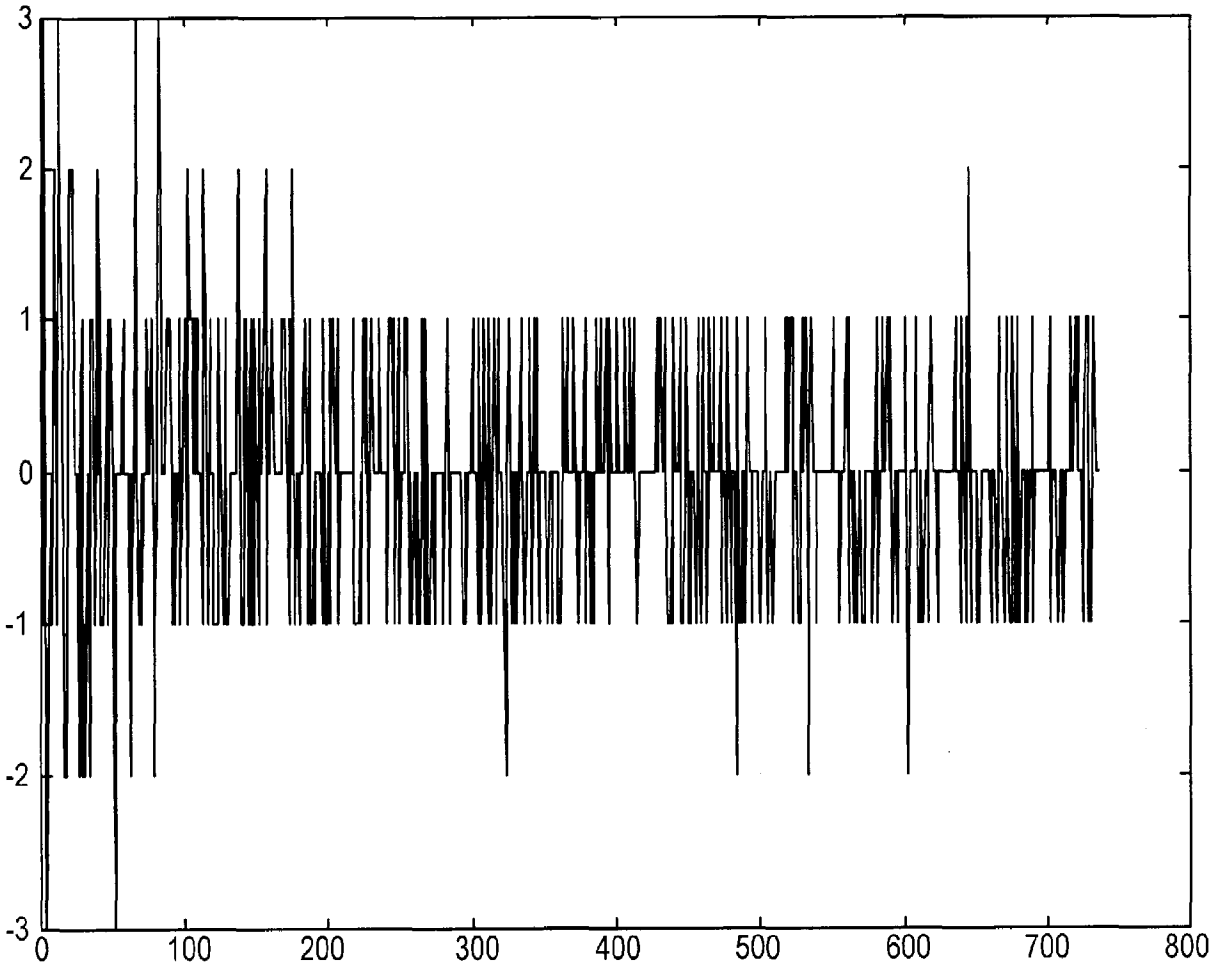
FIG. 11*a* is a plot showing QMDCT coefficients in one of the stereo channels of an AAC frame.
Figure 11B:
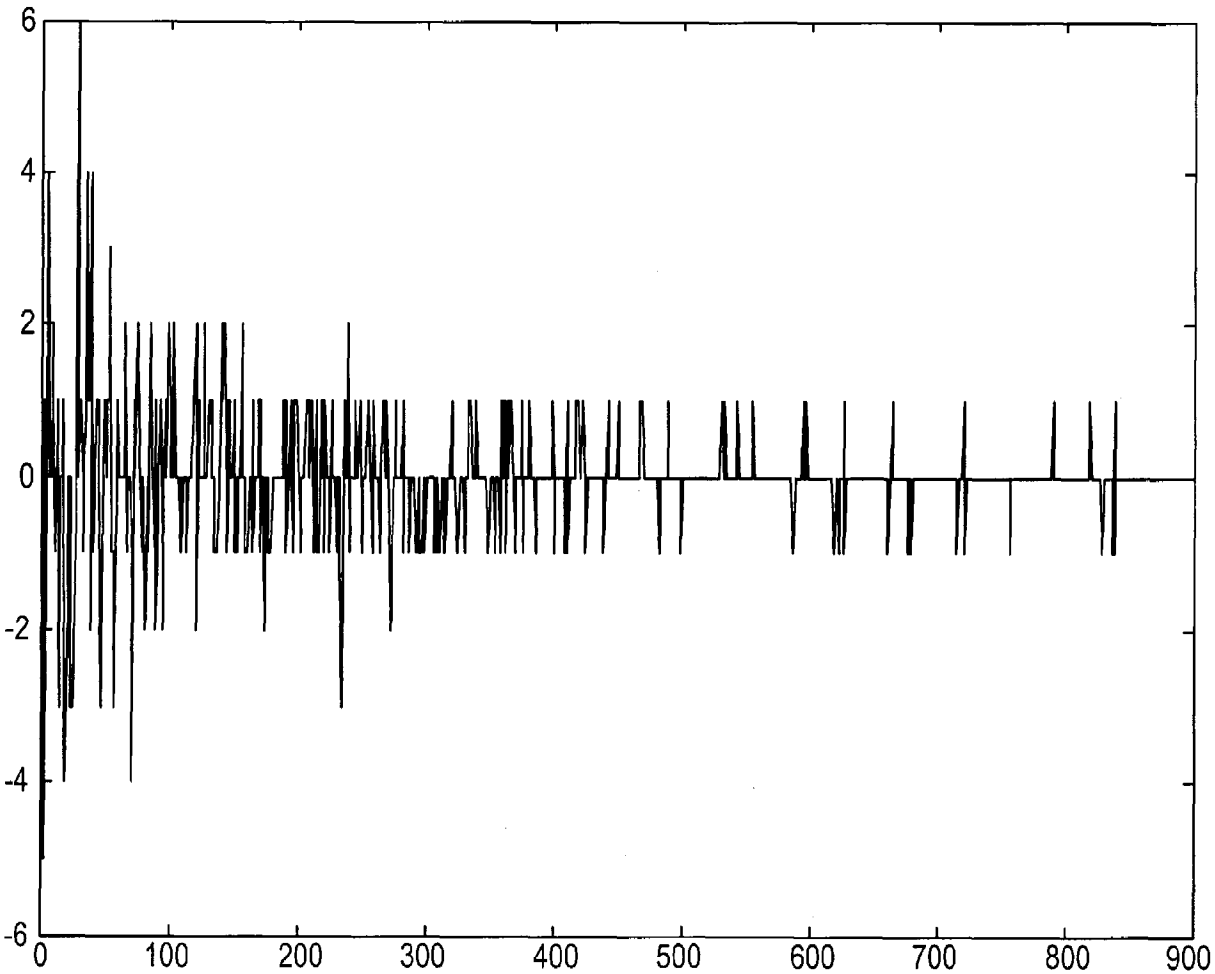
FIG. 11*b* is a s plot showing QMDCT coefficients in another of the stereo channels of the AAC frame.

The most frequent situation in packet loss is that the QMDCT coefficients are corrupted or lost, but the header and the scale factors are available. In this situation, the partial pattern matching approach can also be used to recover the lost QMDCT coefficients. An example of QMDCT coefficients of an AAC frame is shown in FIGS. 11*a* and 11*b*. During audio streaming, a feature vector (FV) based on the QMDCT coefficients of a received frame is continuously calculated. The features used in conjunction with the error concealment method are maximum absolute value, mean absolute value and the bandwidth (the number of non-zero values). The QMDCT coefficients of two stereo channels in an AAC frame are separately shown in FIGS. 11*a* and 11*b*. As shown, the large values are usually concentrated in the low frequency region. In order to recover the lost QMDCT coefficients in a frame, the QMDCT coefficients are divided into two frequency regions based on their means and variance. In the low frequency region, it is preferred that a time domain correlation method is used to recover the generally big values. For example, if the QDMCT coefficients are missing, they can be replaced by the corresponding coefficients in the likely correlated QMDCT vector. Here feature vector is used to find out the likely correlation. In the high frequency region, however, a different method is preferred.

In order to recover the QMDCT in the high frequency region, two situations are assumed. If the entire QMDCT coefficients of a frame are lost (max 1024), it is preferred that the buffered information alone is used to recover the missing QMDCT coefficients. The lag value (1 or 2) using the autocorrelation of the FVs in the previous frame is calculated in order to determine whether inter-channel or inter-frame correlation should be used. Based on the lag value, it can be determined whether a different channel of the same frame or the same channel of a different frame is used. With lag values calculated from frames, it is also possible to determine which previous frame is to be used to replace the missing one. In order to prevent the fill-in QMDCT coefficients from exceeding the maximum value as defined by the Huffman codebook being used, the fill-in QMDCT coefficients should be clipped. The entire fill-in QMDCT coefficients can be decreased by a constant, for example, so that there will not be an energy surge in the fill-in frame.

If only an isolated cluster of QMDCT coefficients (a cluster of 2 or 4, for example) in the high frequency region is lost, the simplest way to conceal the errors is to replace all the missing QMDCT coefficients with zeros.

In a situation where only an isolated cluster of QMDCT coefficients in the low frequency region is lost, inter-frame correlation can be used to check the partial Euclidian distance with neighboring frames, and the fill-in coefficients are modified by a decreasing factor in order to prevent a false energy surge from occurring.

FIG. 12 is a block diagram showing an AAC decoder at the receiver side, which is capable of carrying out error concealment in the compressed domain, according to the present invention, as well as error concealment in the MDCT domain. Furthermore, it is capable of concealing errors in percussive sounds in the PCM domain, as discussed in copending U.S. patent application Ser. No. 10/281,395. As shown in FIG. 12, at the receiver side 5, a packet unpacking module 20 is used to convert the packet data 200 into an AAC bitstream 210. Information 202 indicative of a codebook is provided to a percussive codebook buffer 22 for storage. At the same time, information 204 indicative of a packet sequence number is provided to an error checking module 24 in order to check whether a packet is missing. If so, the error checking module 24 informs a bad frame indicator 28 of the loss packet. The bad frame indicator 28 also indicates which element in the percussive codebook should be used for error concealment. Based on the information provided by the bad frame indicator 28, a compressed domain error concealment unit 30 provides information to an AAC decoder 10 indicative of corrupted or missing audio frames. In parallel, a code-redundancy check (CRC) module 26 is used to detect a bitstream error in the decoder 10. The CRC module 26 provides information indicative of a bitstream error to the bad frame indicator 28. A plurality of buffers 32, 34 and 36, operatively connected to the compressed domain error concealment module 30, are used to store data indicative of the header and global_gain, the scale factors and the QMDCT coefficients. Depending on what data parts are missing in an AAC frames, the data in the buffers 32, 34 and 36 are used to derive or compute the missing data parts. Advantageously, a buffer 42 is also provided in order to store MDCT coefficients and an MDCT domain error concealment module 40 is used to conceal the errors if the scale factors and QMDCT data of the bad frame are set to zero. After errors in the AAC bitstream 210 are concealed in the compressed domain or the MDCT domain, the AAC decoder 10 decodes the AAC bitstream into PCM samples 240. Based on information indicative of percussive sound as provided by the playback buffer 50, a PCM domain error concealment unit 52 uses the codebook element 206 provided by the percussive code buffer 22 to reconstruct the corrupted or missing percussive sounds. The error-concealed PCM samples 250 are provided to a playback device.

It should be noted that the receiver 5, as described above, also includes error concealment modules and buffers to reconstruct the corrupted or missing percussive sounds in an audio bitstream. The detail of percussive sound recovery has been disclosed in the copending U.S. patent application Ser. No. 10/281,395. However, the method and device for compressed-domain packet loss concealment, according to the present invention, can be implemented without the percussive sound recovery scheme.

Figure 13:
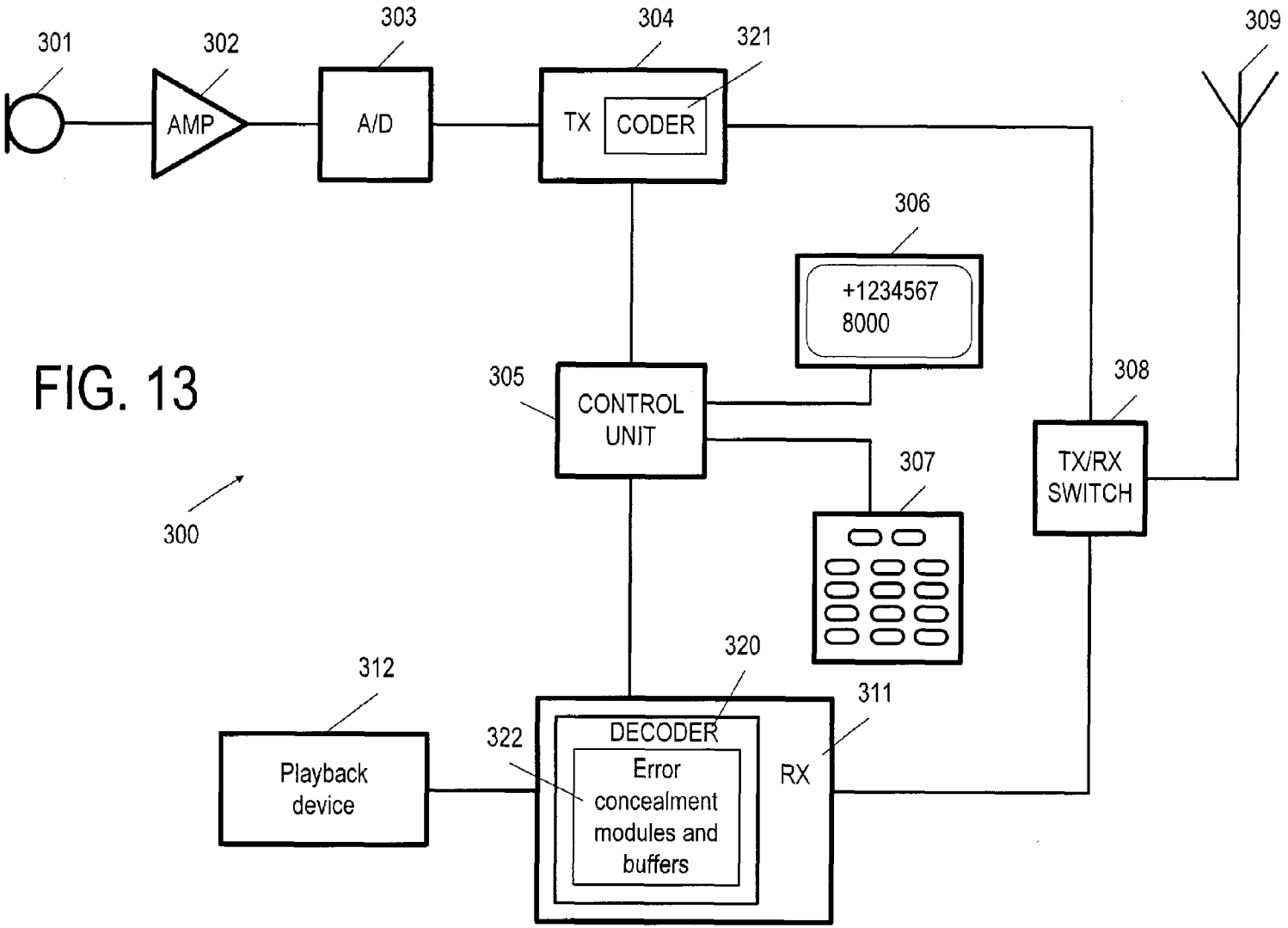
FIG. 13 is a block diagram showing a mobile terminal having an error concealment module, according to the present invention.

The error concealment method and device, can be used in a mobile terminal, as shown in FIG. 13. FIG. 13 shows a block diagram of a mobile terminal 300 according to one exemplary embodiment of the invention. The mobile terminal 300 comprises parts typical of the terminal, such as a microphone 301, keypad 307, display 306, transmit/receive switch 308, antenna 309 and control unit 305. In addition, FIG. 13 shows transmitter and receiver blocks 304, 311 typical of a mobile terminal. The transmitter block 304 comprises a coder 321 for coding the speech signal. The transmitter block 304 also comprises operations required for channel coding, deciphering and modulation as well as RF functions, which have not been drawn in FIG. 13 for clarity. The receiver block 311 comprises a decoding block 320 which is capable of receiving compressed digital audio data for music listening purposes, for example. Thus, the decoding block 320 comprises a decoder, similar to the AAC decoder 10, and error concealment modules/buffers 322 similar to the compressed domain error concealment module 30, MDCT domain error concealment module 40 and buffers 32, 34, 36, 42 as shown in FIG. 12. The signal coming from the microphone 301, amplified at the amplification stage 302 and digitized in the A/D converter 303, is taken to the transmitter block 304, typically to the speech coding device comprised by the transmit block. The transmission signal, which is processed, modulated and amplified by the transmit block, is taken via the transmit/receive switch 308 to the antenna 309. The signal to be received is taken from the antenna via the transmit/receive switch 308 to the receiver block 311, which demodulates the received signal. The decoding block 320 is capable of converting packet data in the demodulated received signal into an AAC bistream containing a plurality of frames. The error concealment modules, based on the data stored in the buffers, recover the lost data in a defective frame. The error-concealed PCM samples are fed to a playback device 312. The control unit 305 controls the operation of the mobile terminal 300, reads the control commands given by the user from the keypad 307 and gives messages to the user by means of the display 306.

Thus, although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A method of error concealment in a bitstream indicative of audio signals, wherein the bitstream comprises a current frame and at least one neighboring frame, each frame having a plurality of data parts in a compressed domain, said method characterized by storing said plurality of data parts in the compressed domain in said at least one neighboring frame, determining whether the current frame is defective, detecting at least one defective data part in the current frame if the current frame is defective, and recovering said at least one defective data part in the current frame based on at least one of the stored data parts in said at least one neighboring frame.

2. The method of claim 1, wherein said at least one defective data part in the current frame includes a header and said recovering is based on a statistical characteristic associated with the header of said at least one of the stored data parts in said at least one neighboring frame.

3. The method of claim 1, wherein said at least one defective data part in the current frame includes a window sequence, and said at least one of the stored data parts includes the window sequence in said at least one neighboring frame for recovering said at least one defective data part in the current frame.

4. The method of claim 1, wherein said at least one defective data part in the current frame includes a window shape, and said at least one of the stored data parts includes the window shape in said at least one neighboring frame for recovering said at least one defective data part in the current frame.

5. The method of claim 1, wherein said at least one defective data part in the current frame includes a global gain value, and said at least one of the stored data parts include the global gain value in said at least one neighboring frame for recovering said at least one defective data part in the current frame.

6. The method of claim 1, wherein said at least one defective data part in the current frame includes a global gain value, and said at least one neighboring frame includes a first frame having a first global gain value and a second frame having a second global gain value smaller than the first global gain value, and wherein said at least one defective data part in the current frame is recovered based on the second global gain value.

7. The method of claim 1, wherein said at least one defective data part in the current frame includes one or more scale factors, and said at least one of the stored data parts includes one or more scale factors in said at least one neighboring frame for recovering said at least one defective data part in the current frame.

8. The method of claim 1, wherein said at least one defective data part in the current frame includes a plurality of transform coefficients and said at least one of the stored data parts includes the plurality of transform coefficients in said at least one neighboring frame for recovering said at least one defective data part in the current frame.

9. The method of claim 8, wherein the transform coefficients comprise QMDCT coefficients.

10. The method of claim 9, wherein the QMDCT coefficients comprises coefficients in a higher frequency region and a lower frequency region, wherein the coefficients in the lower frequency region of the defective data part are recovered based on the corresponding coefficients in the lower frequency region in said at least one neighboring frame.

11. An audio decoder for decoding a bitstream indicative of audio signals for providing audio data in a modulation domain, wherein the bitstream comprises a current frame and at least one neighboring frame, each frame having a plurality of data parts, said decoder comprising a first module for decoding said each frame for providing a signal indicative of the plurality of data parts in a compressed domain, said decoder characterized by a second module, responsive to the signal, for storing said plurality of data parts in the compressed domain in said at least one neighboring frame, and by a third module for detecting at least one defective data part in the compressed domain if the current frame is defective, so as to recover said at least one defective data part in the current frame based on at least one of the stored data parts in said at least one neighboring frame.

12. An audio receiver adapted to receive packet data in audio streaming, said receiver comprising an unpacking module for unpacking the received packet data into a bitstream indicative of audio signals, wherein the bitstream comprises a current frame and at least one neighboring frame, each frame having a plurality of data parts, said receiver characterized by a decoding module, for decoding said each frame for providing a signal indicative of the plurality of data parts in a compressed domain, by a storage module, responsive to the signal, for storing said plurality of data parts in the compressed domain in said at least one neighboring frame, and by an error concealing module for detecting at least one data part in the current frame if the current frame is defective so as to recover said at least one defective data part in the current frame based on at least one of the stored data parts in said at least one neighboring frame.

13. A mobile terminal comprising an antenna, and an audio receiver connected to the antenna for receiving packet data in audio streaming, wherein the receiver comprises an unpacking module for unpacking the received packet data into a bitstream indicative of audio signals, wherein the bitstream comprises a current frame and at least one neighboring frame, each frame having a plurality of data parts, and wherein the receiver further comprises:

a decoding module, for decoding said each frame for providing a signal indicative of the plurality of data parts in a compressed domain, a storage module, responsive to the signal, for storing said plurality of data parts in the compressed domain in said at least one neighboring frame, and an error concealing module for detecting at least one data part in the current frame if the current frame is defective so as to recover said at least one defective data part in the current frame based on at least one of the stored data parts in said at least one neighboring frame.

* * * * *